United States Patent [19]

Atherton et al.

[11] 4,079,530

[45] Mar. 21, 1978

[54] GARDEN MARKER

[76] Inventors: Marie E. Atherton; Jesse J. Atherton, both of 1414 E. N. St., Algona, Iowa 50511

[21] Appl. No.: 728,761

[22] Filed: Oct. 1, 1976

[51] Int. Cl.[2] ..... G09F 3/18

[52] U.S. Cl. ..... 40/10 C; 40/16.4

[58] Field of Search ..... 40/10 C, 152, 156, 124.5, 40/16, 16.4, 159

[56] References Cited

U.S. PATENT DOCUMENTS

| | | | |
|---|---|---|---|
| 519,256 | 5/1894 | Greene | 40/16.4 |
| 833,663 | 10/1906 | Bateman | 40/10 C |
| 1,463,150 | 7/1923 | Carlsen | 40/152 |
| 2,010,246 | 8/1935 | Slawson | 40/10 C X |
| 2,114,083 | 4/1938 | Movius | 40/10 C |
| 2,207,180 | 7/1940 | Smith et al. | 40/10 C |
| 2,874,498 | 2/1959 | Bukevitch | 40/152 |
| 3,281,976 | 11/1966 | Riedel | 40/152 |
| 3,321,855 | 5/1967 | Phelps | 40/16.4 |

*Primary Examiner*—Russell R. Kinsey
*Assistant Examiner*—Wenceslao J. Contreras
*Attorney, Agent, or Firm*—Burd, Braddock & Bartz

[57] ABSTRACT

An identification marker as a garden marker to indicate crop rows. The marker has an elastic backing including a plate having a front first label support surface, an elongated stake mounted to the bottom of the plate and depending downwardly therefrom, and a supporting rib integral with back surfaces of the plate and stake and extending rearwardly therefrom. A frame as adapted for selected face-to-face contact with the plate. The frame includes an inner frame portion which defines a display opening, and an outer frame portion surrounding the inner frame portion. An outer frame portion back surface abuts the plate front surface during said selected contact, while an inner frame portion back surface, parallel to and forward with respect to the outer frame back surface, comprises a second label support surface. A retaining wall is between the inner and outer frame back surfaces. The marker further includes means for maintaining said selected face-to-face contact. The means are adapted to allow slidable insertion of a display label or seed pack through a passageway between the frame and the plate to a display position wherein the label is supported between the first and second label supporting surfaces inwardly of the retaining wall, one face of the label being viewable through the display opening.

20 Claims, 16 Drawing Figures

GARDEN MARKER

BACKGROUND OF THE INVENTION

Use of markers to identify rows of garden crops and flower beds is well known. An early method involved simply inserting an empty seed packet into the cleft end of a stick, then inserting the other end of the stick into the ground proximate to the row of seeds. This method is unsatisfactory in that the packets when exposed to weather become soiled, wrinkled and torn, reducing or destroying readability.

The use as garden markers of wooden stakes bearing crop-identifying inscriptions is an improvement over the paper seed packet and stick. An example of such a stake is seen in U.S. Pat. No. 2,294,567 to Mooney granted Sept. 1, 1942. When exposed to the weather, inscriptions on the wooden stakes tend to become blurred and illegible. One attempt to solve this problem is by use of a transparent cellophane casing as in U.S. Pat. No. 2,181,977 to Magovern on Dec. 5, 1939.

Transparent materials have been used to envelope the seed label in an attempt to protect it from the weather. In U.S. Pat. No. 2,012,990 to Choate granted Sept. 3, 1935 and U.S. Pat. No. 2,333,302 to Enk granted Nov. 2, 1943, a framework supported by one or more metal legs inserted into the ground supports the seed packet, which is covered by a transparent material, for example celluloid. In the Choate device, the celluloid and the label or seed packet are slidably mounted within the framework, while in Enk, the transparent cover slips over the framework as well as the seed packet. The framework and legs comprise one piece of formed wire in Enk, while in Choate a sheet metal frame is welded to a metal supporting rod.

More elaborate devices involve a label supporting frame and platform obliquely mounted on a stake. U.S. Pat. No. 833,633 to Bateman granted Oct. 16, 1906 includes an inclined head and stake. A partial frame surrounds the head on the top and two sides. The frame retains an information-bearing card and a transparent protective strip over the card. U.S. Pat. No. 1,966,922 granted to Coleman July 17, 1934 is for a grave marker. A rectangular base plate is supported on a spike. Mounted on the base plate in ascending order are a waterproof material, an information card, a transparent panel and a rectangular washer, all held in place by a frame fastened to the base plate. Additional examples of inclined label supporting surfaces mounted with respect to a stake are seen in Design Patent No. D-186,779 granted to Borin on Dec. 1, 1959 and British Patent No. 1913 to Stewart-Wortley granted Feb. 11, 1885. Inclined surfaces direct the label face upwardly and expose it to rain, therefore requiring transparent covering means to insure satisfactory long-term use.

Design Patent No. D-170,936 to Pegram granted Nov. 24, 1953, shows a rectangular compartment suitable for holding a label supported by a downwardly converging leg. A scarecrow configuration extends upwardly from the label supporting compartment.

SUMMARY OF THE INVENTION

The invention relates to an identification marker particularly well suited for labeling flowerbeds, crop rows and the like. In the first form of marker shown, an elastic and compressible frame is supported against an elastic and compressible backing. The backing includes a flat plate having a front or first label support surface and a back surface opposed to the front surface. An elongated flat stake depends downwardly from the center of the bottom edge of the plate. The backing further includes an elongated rib mounted to the stake and plate back surfaces and directed rearwardly therefrom. The rib spans the distance from the bottom of the stake to the top edge of the plate.

The frame is adapted for face-to-face contact with the plate, the frame and plate outer edges in alignment. The frame includes an inner frame portion and an outer frame portion surrounding the inner frame portion. The inner edge of the inner frame portion defines in the frame a display opening. Coplanar front surfaces of the inner and outer frame portions comprise the frame front surface. The outer frame portion back surface is adapted to abut a portion of the plate front surface during said selected face-to-face contact. A second label support surface or back surface of the inner frame portion is parallel to the outer frame portion back surface but forward with respect thereto. A retaining wall is located between the inner and outer frame portion back surfaces and is substantially perpendicular thereto.

Means are provided for maintaining the selected face-to-face contact. The means are adapted to allow slidable insertion of a seed packet or display label through a passageway between the plate and the frame to a display position. Once in the display position, the seed packet is supported between the first and second labeling supporting surfaces and surrounded entirely by the retaining wall. Printed matter on the packet may then be viewed through the display opening.

If removal of the seed packet is desired, it may be accomplished merely by sliding the packet from the display position through the passageway. In like manner, any number of alternative seed packets or display labels may be inserted into the garden marker and removed therefrom.

In a first form of the invention, the fastening means includes a plurality of buttons mounted to the back surface of the outer frame portion and extending rearwardly thereof. The buttons are adapted for alignment with openings provided in the plate. Each button includes a stem with a diameter approximately the same as that of its corresponding opening, and a head, rearward with respect to the stem and having a diameter greater than that of the corresponding opening. Each head has a slit and is elastic whereby the head deforms to allow its insertion through the corresponding opening upon application of moderate finger pressure. Once through the opening, the head reassumes its original shape, thereby preventing retraction of the button from the opening and maintaining the selected face-to-face contact in the vicinity of the button. The passageway is between two adjacent buttons.

In a second form of the invention shown, the frame and backing together are one unitary member of an elastic, compressible material. The fastening means includes a plurality of buttons extending rearwardly from the outer frame portion back surface. Corresponding openings are provided in the plate and insertion of each buttom through its corresponding plate opening is accomplished in the manner described in connection with the first form of the invention. The fastening means also includes a membrane connecting the plate and the frame. The membrane, thinner than the plate or the frame, is foldable to direct each button into position for insertion into its associated opening. The membrane cooperates with all buttons, once inserted, to maintain the selected contact. The seed packet passageway is between the membrane and a button adjacent to the membrane.

Either form of the invention is amenable to manufacture by casting, injection molding, and the like. Final assembly involves merely pressing a frame and plate together and may be accomplished by hand or machine. The marker is therefore inexpensive and simple to manufacture. Due to its construction of compressible plastic material, the garden marker is sturdy, corrosion resistant, is easily cleaned and maintains a neat and tidy appearance requiring negligible maintenance. Because of its relatively flat construction, storage problems are minimal.

The passageway in the garden marker allows repeated and convenient insertion and removal of a particular seed packet or any number of packets with negligible wear to the garden marker, there being no need to disassemble the marker to accomplish insertion or removal. The compartment for the seed packet formed by the plate front surface, the inner frame portion back surface and the retaining wall, secures the packet against unintentional removal from the marker and provides protection from the weather.

The marker is made of rugged, durable material, as polypropylene, and has a variety of uses, including marking garden row crops, plate identification, product identification and pricing; house number holder, parking space markers, and the like.

Figure 7:
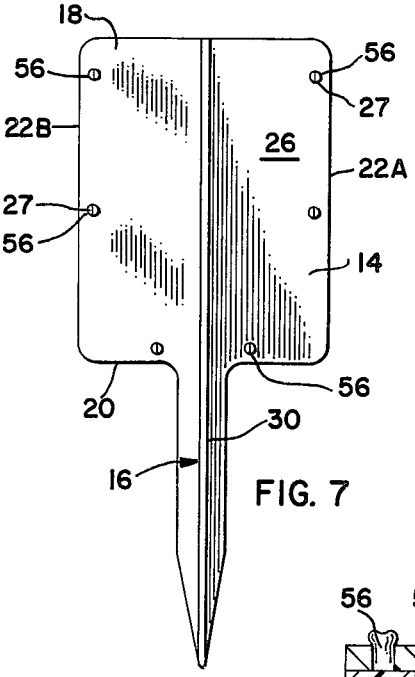
FIG. 7 is a rear elevation of the identification marker.

DETAILED DESCRIPTION OF THE PREFERRED EMBODIMENTS:

Referring to the drawings, there is shown in FIGS. 1 through 4 and in FIG. 7 a garden marker 10 of a kind frequently used to identify one or more rows of garden crops, and preferably constructed entirely of elastic, compressible plastic.

Marker 10 can also be made of other materials, as metal, wood and the like. Marker 10 can be used to hold all types of indicia to mark and identify products or locations. The following description is directed to a marker to identify plants in a garden. It is not intended to limit the use of the marker to a row crop identification item.

Garden marker 10 includes a flat and rectangular frame 12 supported on a backing including a plate 14 and an elongated stake 16. Stake 16 extends along the longitudinal axis of plate 14. Plate 14 is rectangular and includes a top edge 18, two bottom edges 20 parallel and opposed to top edge 18, and two parallel and opposed side edges 22A, 22B. Plate 14 also has a front surface 24 which is generally flat and comprises a first label support surface. The back plate 14 has a back surface 26 which is flat and opposed to front surface 24. Plate 14 is provided, proximate to its edges 22A and 22B, with a plurality of openings or holes 27, shown in FIGS. 5 and 7.

Stake 16 depends downwardly from the center of the bottom of plate 14 and includes front and back surfaces 16A and 16B generally coplanar with plate front and back surfaces 24 and 26, respectively. Stake 16, preferably, includes at the bottom a tapered portion or nose 28 to facilitate insertion of garden marker 10 into the ground.

Figure 6:
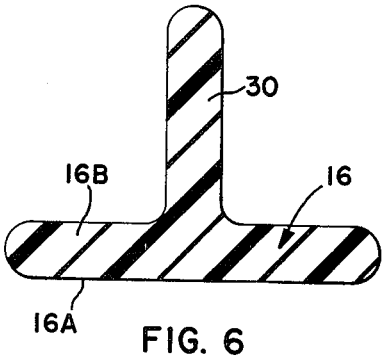
FIG. 6 is an enlarged sectional view taken along the line 6—6 in FIG. 1.

The backing further includes an elongated rib 30, mounted at the common longitudinal center of plate 14 and stake 16 and directed rearwardly therefrom. Rib 30 spans the distance from plate top edge 18 to the bottom end of stake 16. Rib 30 provides strength and rigidity in marker 10. At the bottom of rib 30 is a rib tapered portion 32. Throughout the majority of length of stake 16, a rib 30 and stake 16 define a T cross section as seen in FIG. 6. Tapered portions 28 and 32 taper toward a common tip.

Figure 1:
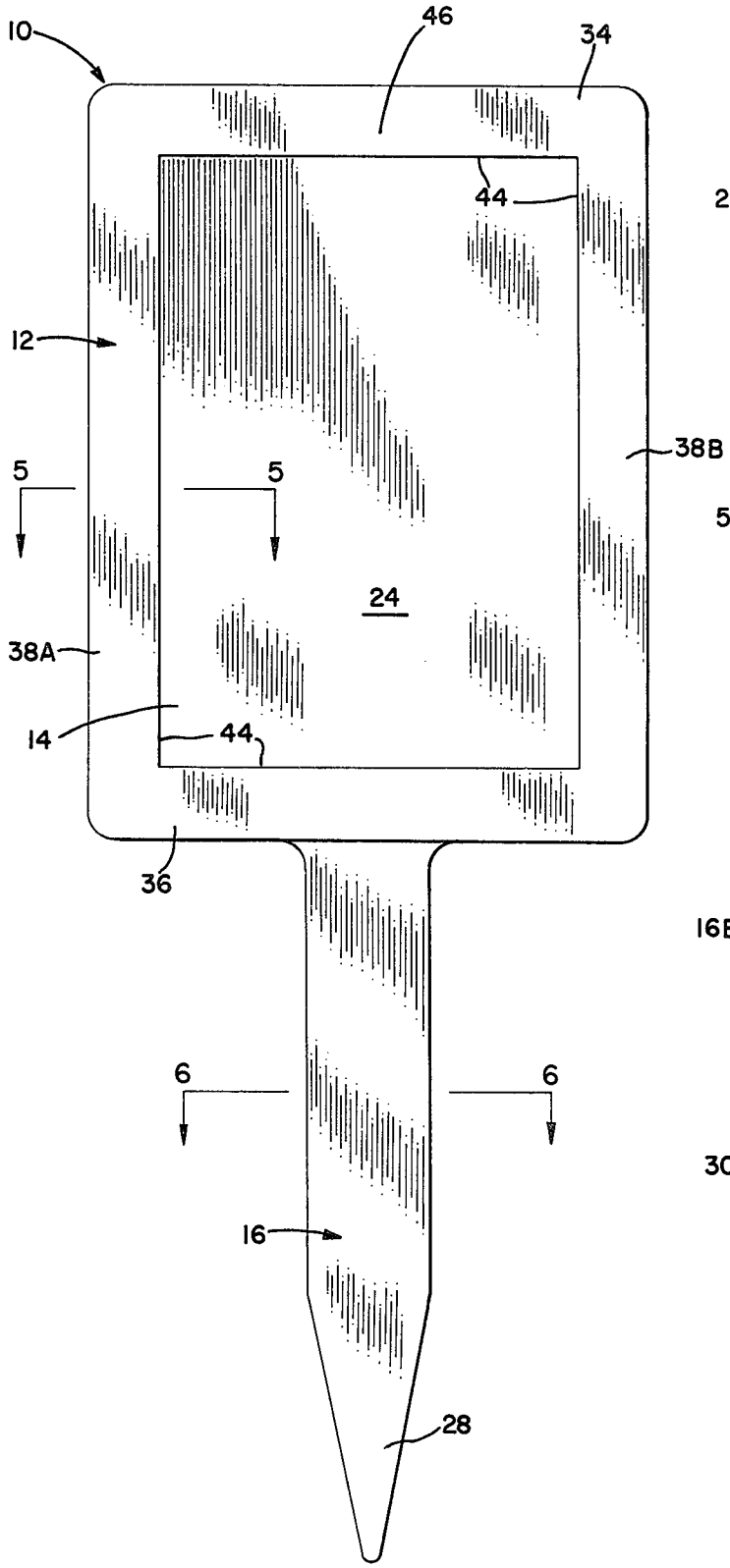
FIG. 1 is a front elevational view of an identification marker assembled according to the invention.
Figure 2:
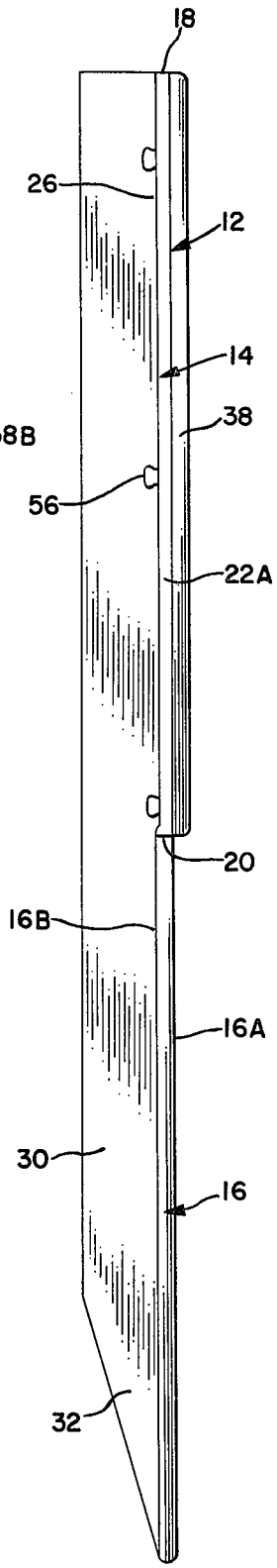
FIG. 2 is a side elevation of the identification marker.
Figure 3:
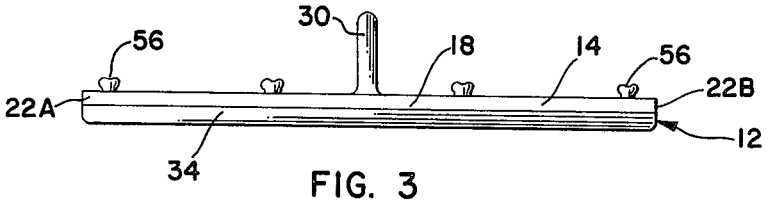
FIG. 3 is a top view of the identification marker.
Figure 4:
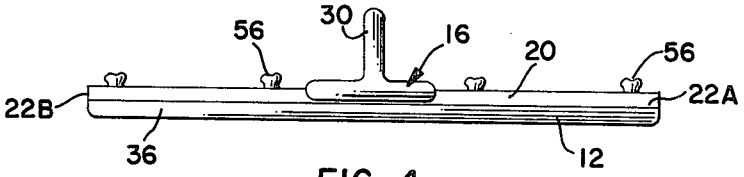
FIG. 4 is a bottom view of the identification marker.
Figure 5:
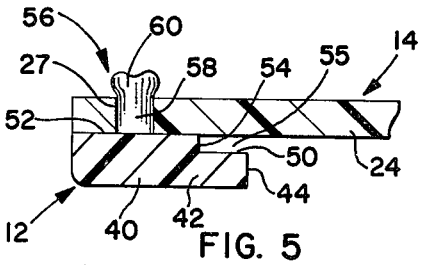
FIG. 5 is an enlarged sectional view taken along the line 5—5 in FIG. 1.

Returning to FIG. 1, it is seen that frame 12 includes a frame top member 34, a frame bottom member 36 parallel and opposed to top member 34, and two parallel and opposed frame side members 38A, 38B. As best seen in FIG. 5, each frame member 36, 38A, 38B includes a body 40 and a shelf or lip 42 inwardly of body 40. While only one of side members 38A is shown in transverse cross section, the cross sections for the other of side member 38B, top member 34 and bottom member 36 are substantially identical. The bodies together comprise an outer frame, while the shelves 42 combine to form an inner frame, the inward edges 44 of shelves 42 together defining a rectangular display opening 46.

Front surfaces of the bodies 40 and shelves 42 are coplanar and combine to form a single frame front surface. Shelf 42 has rear surfaces 50 occupy a plan forward with respect to body rear surfaces 52. Shelf rear surfaces 50 comprise a second label support surface. Separating shelf rear surfaces 50 from body rear surfaces 52 is a retaining wall 54, substantially perpendicular to rear surfaces 50 and 52. Shelf rear surfaces 50 and plate front surface 24 are in spaced relation to one another at a distance equal to the width of retaining wall 54 forming a groove 55 to accommodate the outer peripheral edge of the label 62.

Means holding frame 12 and plate 14 together in face-to-face contact are most clearly shown in FIG. 5. Frame 12 is provided at side members 38A, 38B and bottom member 36 with a plurality of buttons 56 extending rearwardly from body rear surfaces 52, each button 56 adapted for alignment with one of openings 27. Each of buttons 56 includes a cylindrical stem 58 having a diameter approximately equal to that of its associated opening 27. Each button 56 further includes a head 60 rearwardly of the stem and having a diameter greater than that of the associated opening 27. The head 60 has a groove or slit in the outer end thereof.

Fastening is accomplished by positioning frame 12 and plate 14 in alignment such that each button 56 aligns with an opening 27, and applying moderate finger pressure to each button. Each head 60, being elastic, will deform a sufficient amount to allow its passage through its associated opening 27. Once through opening 27, head 60 regains its original shape. This prevents return of head 60 through opening 27 unless sufficient force is applied in the opposing direction. The length of stem 58 is approximately equal to that width of plate 14. Consequently, pressure from head 60 will maintain plate 14 and frame 12 in face-to-face contact in the vicinity of the button 56. With all of buttons 56 inserted through all associated openings 27, the entire frame 12 and plate 14 are held in face-to-face contact.

Figure 8:
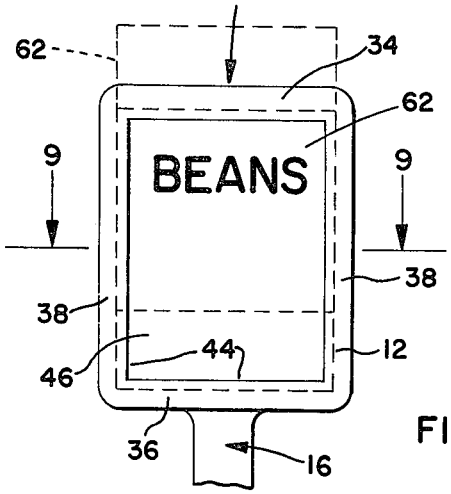
FIG. 8 is a front view of the identification marker, foreshortened, with a display label supported therein.

Frame top member 34 is not provided with any buttons. The absence of buttons therein provides a passageway of sufficient width to allow slidable insertion of a display label 62 between frame top member 34 and plate 14, as shown by the arrow in FIG. 8. The two uppermost buttons 56 and frame top member 34 and plate 14 define this passageway. Display label 62 is mounted merely by sliding it through the passageway to a display position wherein label 62 is supported between the first and second label supporting surfaces, contained against lateral movement by retaining wall 54. The dotted line in FIG. 8 indicates locations of label 62 as partially inserted and as fully inserted. Completely inserted, the script portion of label 62 is visible through display opening 46.

Figure 9:
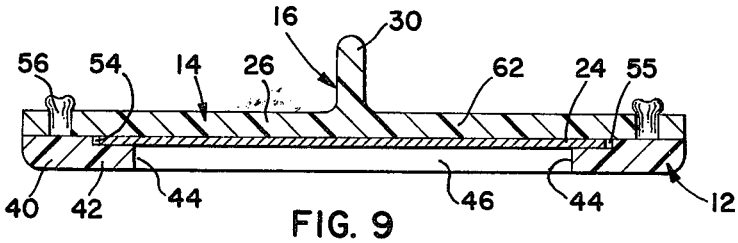
FIG. 9 is an enlarged sectional view taken along the line 9—9 in FIG. 8.

Retention of label 62 in groove 55 between shelf rear surfaces 50 and plate front surface 24 and inwardly of retaining wall 54 is best seen from FIG. 9. It is apparent that any generally rectangular display label having a width and length each less than the associated distance between retaining walls 54 and greater than the associated distance between shelf inward edges 44 is containable in the manner described.

If it is desired that display label 62 be replaced with a new label, one merely removes label 62 through the passageway, then inserts the desired new label in the same manner in which label 62 was inserted. This is accomplished without damage to garden marker 10 and without necessity to separate frame 12 from plate 14. Thus, any desired number of labels may be inserted and removed from garden marker 10 without appreciable wear or damage to garden marker 10.

Figure 10:
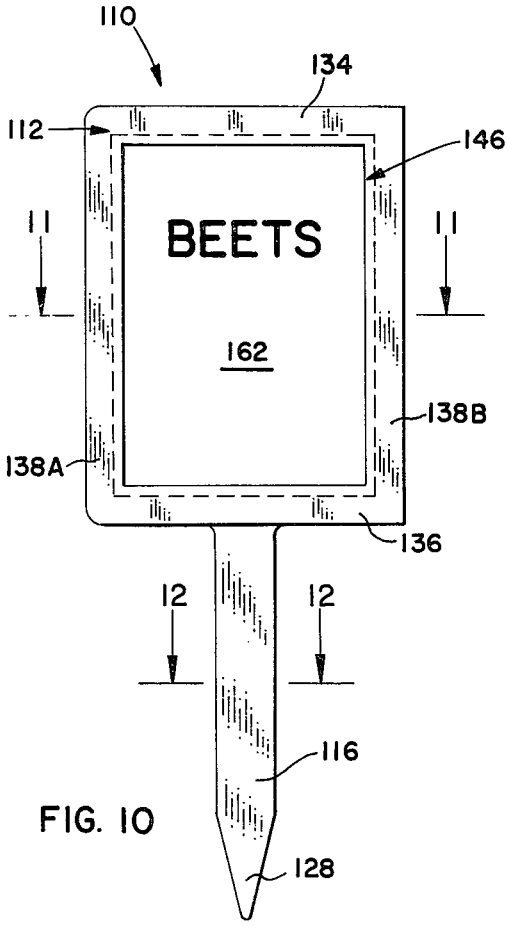
FIG. 10 is a front elevational view of a second form of identification marker supporting a display label.

FIG. 10 is an illustration of the invention in a modified form, wherein a garden marker 110 has an appearance quite similar to that of first form garden marker 10. Marker 110 is preferably a unitary member of elastic, compressible material, such as a plastic. Marker 110 includes a rectangular frame 112 supported on a backing including a rectangular plate 114 and a downwardly depending elongated stake 116. Plate 114 includes a top edge 118, bottom edges 120, and two parallel and opposed side edges 122 and 123. A plate front surface 124 comprises the first label support surface. A plate back surface 126 is parallel and opposed to front surface 124. Proximate to edges 120 and 122, plate 114 is provided with a plurality of openings or holes 127.

Stake 116 includes front and back surfaces generally coplanar with plate front and back surfaces 124 and 126, respectively. Stake 116 includes a bottom tapered portion 128 to facilitate insertion of marker 110 into the ground.

Figure 12:
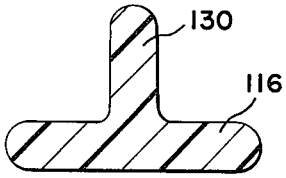
FIG. 12 is an enlarged sectional view taken along the line 12—12 in FIG. 10.

The backing further includes a rib 130 mounted at the common longitudinal center of plate 114 and stake 116 and extending rearwardly therefrom. Rib 130 extends from plate top edge 118 to the bottom of stake 116. Rib 130 is tapered at the bottom end to facilitate insertion of garden marker 110 into the ground. Along untapered portions, rib 130 and stake 116 together in cross or T section appear as shown in FIG. 12.

Figure 15:
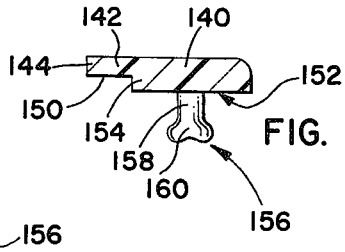
FIG. 15 is an enlarged sectional view taken along the line 15—15 in FIG. 13.

Frame 112 includes a top member 134, a bottom member 136, and two parallel and opposed side members 138A, 138B. Each member, shown in FIG. 15, consists of a body 140 and a shelf 142, the bodies combining to comprise an outer frame portion while the shelves combine to form an inner frame portion. Inward edges 114 of shelves 142 together define a display opening 146.

Figure 11:
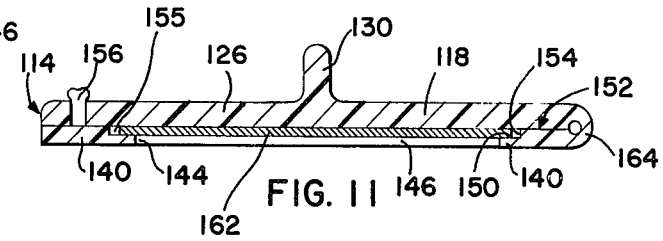
FIG. 11 is an enlarged sectional view taken along the line 11—11 in FIG. 10.

Front surfaces of the bodies 140 and shelves 142 are coplanar and together form a frame front surface. Shelf rear surfaces 150 and body rear surfaces 152 are not coplanar, shelf rear surfaces 150 being forward with respect to the body rear surfaces 152 and combining to form a second label support surface. A retaining wall 154 separates rear surfaces 150 and 152 and is perpendicular thereto. Shelves 142 form a groove 155 for accommodating the outer peripheral edges of label 162. In this manner, a display location is provided in garden marker 110 for a display label 162, label 162 being supported between the first and second label supporting surfaces and inside of retaining wall 154, as shown in FIG. 11.

Figure 13:
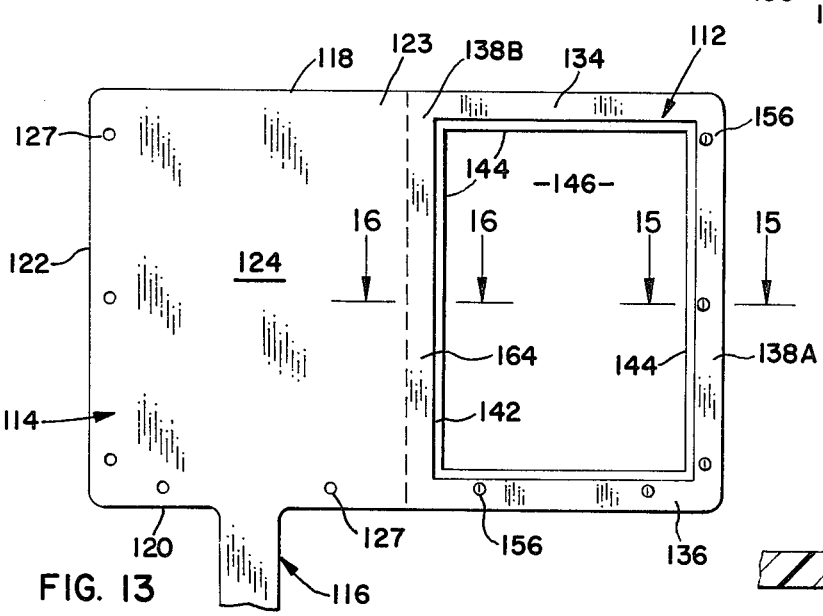
FIG. 13 is a front elevation of the second form of identification marker in the opened position.
Figure 16:
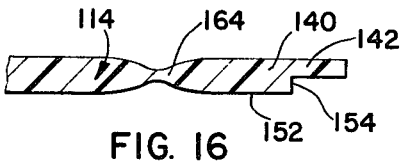
FIG. 16 is an enlarged sectional view taken along the line 16—16 in FIG. 13.
Figure 14:
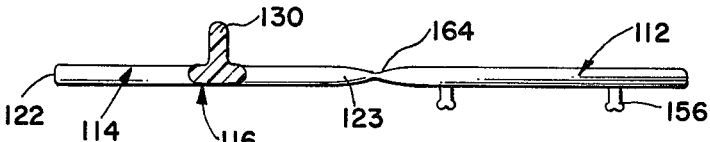
FIG. 14 is a bottom view, partly sectioned, of FIG. 13.

Garden marker 110 is shown in the opened position in FIG. 13. Side edge 123 is connected to a flexible membrane or integral hinge 164, which in turn is connected to one of side members 138. Membrane 164 spans substantially the distance between plate top edge 118 and bottom edge 120. The thickness of membrane 164 is substantially less than that of plate 114 of frame 112, thereby facilitating the folding of membrane 164 in order to achieve closure of garden marker 110. Membrane 164 is a flexible web of material that is integral with the material of edge 123 and side member 128B forming a continuous hinge.

Side member 138 opposed to the side member 138 attached to membrane 164 is provided with a plurality of buttons 156, as is frame bottom member 136. Buttons 156 extend rearwardly from the associated body rear surfaces 152. Each button 156 is adapted for alignment with one of openings 127 in plate 114. Each button 156 includes a stem 158 and a head 160 having a slot or groove in the outer end thereof. The structure of buttons 156 in garden marker 110 is substantially identical to the structure of buttons 56 in garden marker 10, and the fastening function of one decribes the fastening function of the other. Reference is made to the pertinent descriptive portion relating to marker 10.

With garden marker 110 closed, i.e. frame 112 attached to plate 114, a passageway is provided for slidably inserting a display label or seed packet 162, or removing the same, if desired. Marker 110 is made in flat form as shown in FIG. 13. In use, the frame 112 is folded into face-to-face relationship with front surface 124 of plate 114. The flexible membrane 164 serves as a continuous flexible hinge permitting movement of frame 112 relative to plate 114. Buttons 156 pressed through holes 127 to maintain frame 112 adjacent plate 114. The passageway is defined by the uppermost button 156, membrane 164, and by portions of frame 112 and plate 114 between them. Since membrane 164, when folded, as shown in FIG. 11, maintains its adjacent frame side member 138 and plate portion near plate side edge 123 in face-to-face contact, there is no need for buttons 156 along side member 138 adjoining membrane 164.

The passageway and garden marker 110, like that in garden marker 10, allows repeated slidable insertion and removal of display labels or seed packets from the garden marker without damage, wear, or necessity to reopen the closed assembled garden marker. Thus any number of labels may be used alternatively as desired. Any rectangular display label may be used, provided its length and width are less than the associated distance between retaining walls 154 and greater than the distance between the associated shelf inner edges 144.

While both forms of the invention disclosed are garden markers adapted for use with rectangular display labels, the invention contemplates the use of frames and plates of a variety of sizes and shapes in order to accommodate a variety of display labels, as sheet members containing printed matter. The preferred embodiments have been described, and such changes in size and structure may be made by those skilled in the art without departing from the invention.

The embodiments of the invention in which an exclusive property or privilege is claimed are defined as follows:

1. A marker for holding a display label comprising:

a backing including a plate having a flat front surface comprising a first label support surface and a back surface opposed to the front surface, side edges, a top edge and a bottom edge;

the backing including an elongated flat stake mounted with respect to said bottom edge and directed down therefrom, said stake having front and back surfaces generally coplanar with the plate front and back surfaces, respectively;

said backing further including an elongated rib spanning the distance from the outward end of the stake to a plate portion remote from the stake, said rib mounted with respect to the plate and stake back surfaces and directed rearwardly therefrom;

a frame adapted for selected face-to-face contact with the front surface of the plate, said frame having an outer edge aligned with the top, bottom, and both side edges of the plate;

said frame including an inner frame portion having an inner edge which defines in the frame a display opening, and an outer frame portion surrounding the inner frame portion, said outer frame portion having an inner frame back surface engagable with the front surface of the plate, said frame including a flexible portion;

the inner and outer frame portions having coplanar front surfaces which together define a frame front surface, an inner frame portion back surface located parallel to and forward with respect to said outer frame portion back surface, said inner frame portion back surface forming an inwardly open groove to accommodate outer peripheral edges of a label, said inner frame back surface comprising a second label support surface;

said frame further including a retaining wall between the inner and outer frame back surfaces, said retaining wall extended substantially perpendicular to the inner and outer frame back surfaces; and means for maintaining said selected face-to-face contact whereby the outer frame portion back surface contacts a portion of the plate front surface, said means adapted to permit the flexible portion of the frame to be moved away from the plate to allow slidable insertion of a label through a passageway between the frame and the plate to a display position wherein the label is supported between the first and second label supporting surfaces inwardly of the retaining wall, said means further adapted to allow slidable removal of the label through said passageway.

2. The marker of claim 1 wherein: the backing and frame are each a unitary member of compressible, elastic material.

3. The marker of claim 1 wherein: the plate is provided with a plurality of openings proximate to its edge, said openings of a preselected diameter;

wherein the means for maintaining the selected face-to-face contact includes a plurality of buttons mounted with respect to the outer frame portion back surface and extending rearwardly therefrom, each button adapted for alignment with one of said openings;

each button including a cylindrical stem having a diameter no greater than that of its associated opening, each button further including a head rearwardly of the stem and having a diameter greater than that of said opening, the head compressible to allow its insertion through said opening upon application of moderate finger pressure;

the head further adapted to elastically reassume its original shape following insertion, preventing retraction of the button from said opening thereby maintaining said selected face-to-face contact proximate to the button; and wherein said passageway is defined by a pair of adjacent buttons, the portion of the plate between the two buttons and the portion of the frame between the two buttons.

4. The marker of claim 3 wherein: the passageway is between the two buttons most remote from the stake.

5. The marker of claim 1 wherein: the plate, proximate to its edge, is provided with at least one opening of a preselected diameter;

wherein the means for maintaining the selected face-to-face contact includes at least one button mounted with respect to the outer frame portion back surface and extending rearward therefrom, each button adapted for alignment with an opening;

each button including a stem having a diameter no greater than that of its associated opening, and a head rearwardly of the stem and having a diameter greater than that of said opening, said head compressible to allow its insertion through said opening upon application of moderate finger pressure, thereafter to elastically reassume its original shape, preventing retraction of the button from said opening thereby to maintain said selected contact proximate to the button;

said means for maintaining the selected face-to-face contact further including a flexible membrane, integral with the frame and with the plate and foldable to direct each button into position for insertion through its associated opening; and said membrane, when each button is so inserted, cooperating with each button to maintain said selected contact.

6. The marker of claim 5 wherein: the frame, plate, membrane and each button comprise one unitary member of compresible, elastic material.

7. The marker of claim 5 wherein: said passageway is defined by the membrane, an adjacent button, and the plate and frame portions between the membrane and said button.

8. The marker of claim 1 wherein: the plate is rectangular and includes two parallel and opposed side edges, a top edge and a bottom edge, the stake is mounted with respect to the center of the bottom edge, and the rib spans the distance from the top edge to the bottom of the stake; and wherein the frame is rectangular and includes two parallel and opposed side frame members, a top frame member and a bottom frame member, each member including a body and a shelf directed inwardly therefrom, said bodies together comprising the outer frame portion and said shelves together comprising the inner frame portion, the inward edges of the shelves together defining a rectangular opening comprising the display opening, back surfaces of the shelves together comprising the second label supporting surface.

9. The marker of claim 8 wherein: the backing and frame are each a unitary member of elastic, compressible material.

10. The marker of claim 8 wherein: the plate, proximate to its edges, is provided with a plurality of openings of a preselected diameter;

wherein the means for maintaining the selected face-to-face contact includes a plurality of buttons mounted with respect to the outer frame portion back surface and extending rearward therefrom;

each button adapted for alignment with one of the openings, each button including a stem having a diameter no greater than that of its associated opening, and a head rearwardly of the stem and having a diameter greater than that of said opening, the head compressible to allow its insertion through said opening upon application of moderate finger pressure, thereafter to elastically reassume its original diameter, preventing retraction of the button from said opening thereby to maintain said selected face-to-face contact proximate to the button; and the passageway defined by a pair of adjacent buttons and the frame and plate portions between said pair of buttons.

11. The marker of claim 10 wherein: the buttons are mounted on frame members other than the top frame member, the passageway being defined by the two uppermost buttons, the top frame member and the plate portion between said uppermost buttons.

12. The marker of claim 8 wherein: the means for maintaining the selected face-to-face contact includes a membrane mounted with respect with respect to one of the plate edges and with respect to one of the frame members, the membrane spanning substantially the length of its associated frame member;

wherein the plate is provided, proximate to its edges not associated with the membrane, with at least one opening of a preselected diameter;

wherein the means for maintaining the selected face-to-face contact includes at least one button mounted with respect to the outer frame portion back surface and extending rearward therefrom, each button adapted to align with an opening, each button including a stem having a diameter not greater than that of its corresponding opening, and a head rearwardly of the stem having a diameter greater than that of said opening, the head compressible to allow its insertion through the opening upon application of moderate finger pressure, thereafter to elastically reassume its original shape following insertion to prevent retraction of the button from the opening thereby to maintain said selected face-to-face contact proximate to the button; and said membrane foldable to direct button into position for insertion through its associated opening and adapted, following insertion, to cooperate with each button to maintain said selected contact.

13. The marker of claim 12 wherein: the membrane, the frame and the plate are one unitary member of compressible, elastic material, wherein the membrane is connected to one of the side plate edges and to the side frame member adapted for alignment with said side edge during said selected face-to-face contact;

and wherein a plurality of buttons is arranged along the opposing side frame member and the bottom frame member; and said passageway is defined by the uppermost button, the membrane, the top frame member and the plate portion between the uppermost button and the membrane.

14. The marker of claim 1 wherein: the stake and rib are tapered at the bottom end to facilitate insertion into the ground.

15. The marker of claim 1 wherein: said means for maintaining said selected face-to-face contact include a flexible membrane connecting a first edge of the plate to an edge of the frame to hinge the frame to the plate, and means to hold a second edge of the frame to the plate.

16. An apparatus for holding a sheet member comprising: first means having a sheet member support surface, side edges, and a bottom edge, an elongated stake secured to said bottom edge and directed downwardly therefrom, a frame having a display opening adapted for selective face-to-face contact with the front surface, said frame having outer edges that are aligned with the side edges and bottom of the first means, said frame having an inwardly directed lip spaced from the support surface of the first means and forming therewith a peripheral groove for accommodating an outer peripheral edge of the sheet member, said lip holding the sheet member adjacent said support surface of the first means, and second means cooperating with the frame and the first means for holding the frame in face-to-face relation with the first means, said second means including hinge means to movably connect one outer edge of the frame to one side edge of the first means and fastening means to connect the other outer edge of the frame to the other side of the first means, said second means adapted to allow slidable insertion of the sheet member through a passageway between the frame and the first means to locate the sheet member adjacent the support surface of the first means and adjacent the lip on the frame.

17. The apparatus of claim 16 wherein: said hinge means includes a flexible membrane connecting a first edge of the first means to an edge of the frame to hinge the frame to the first means.

18. The apparatus of claim 17 wherein: the fastening means includes a plurality of buttons mounted on the frame, said first means having a plurality of holes aligned with said buttons and of a size to accommodate the buttons, each button having an enlarged head adapted to hold the buttons in assembled relation with the first means.

19. The apparatus of claim 16 including: an elongated rib extended longitudinally of and secured to the first means and the stake.

20. The apparatus of claim 16 wherein: the fastening means includes a plurality of buttons secured to the frame, each button having an enlarged head, said first means having a plurality of holes to accommodate the buttons, said holes having a diameter smaller than the heads of the buttons whereby the heads hold the buttons in assembled relation with the first means.

* * * * *

UNITED STATES PATENT AND TRADEMARK OFFICE

CERTIFICATE OF CORRECTION

PATENT NO. : 4,079,530

DATED : March 21, 1978

INVENTOR(S) : Marie E. Atherton et al

It is certified that error appears in the above-identified patent and that said Letters Patent are hereby corrected as shown below:

Column 2, line 61, "buttom" should be -- button --.

Column 4, line 16, after "back" insert -- of --.

Column 5, line 16, "that" should be -- the --.

Column 10, line 17, after "direct" insert -- each --.

Signed and Sealed this

*Fourth* Day of *July 1978*

[SEAL]

*Attest:*

RUTH C. MASON
*Attesting Officer*

DONALD W. BANNER
*Commissioner of Patents and Trademarks*